US012043901B1

(12) United States Patent
Ferrando et al.

(10) Patent No.: US 12,043,901 B1
(45) Date of Patent: Jul. 23, 2024

(54) COMPOSITE MATERIALS, ARMOR FORMED THEREFROM, AND METHODS FOR MAKING SAME

(71) Applicant: The Government of the United States of America, as represented by the Secretary of the Navy, Arlington, VA (US)

(72) Inventors: William A. Ferrando, Arlington, VA (US); Philip J. Dudt, North Bethesda, MD (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 38 days.

(21) Appl. No.: 17/683,835

(22) Filed: Mar. 1, 2022

(51) Int. Cl.
*C23C 24/04* (2006.01)

(52) U.S. Cl.
CPC ..... *C23C 24/04* (2013.01)

(58) Field of Classification Search
None
See application file for complete search history.

(56) References Cited

U.S. PATENT DOCUMENTS

| | | | | |
|---|---|---|---|---|
| 7,279,023 | B2 | 10/2007 | Pickard et al. | |
| 7,641,709 | B2 | 1/2010 | Pickard et al. | |
| 7,910,219 | B1 | 3/2011 | Withers et al. | |
| 7,955,706 | B1 | 6/2011 | Withers et al. | |
| 10,189,715 | B2 | 1/2019 | Landskron et al. | |
| 2002/0088340 | A1* | 7/2002 | Chu | F41H 5/0421 89/36.02 |
| 2007/0281176 | A1* | 12/2007 | Palumbo | C23C 28/027 473/578 |
| 2010/0304065 | A1* | 12/2010 | Tomantschger | C23C 16/0227 427/322 |
| 2013/0263727 | A1* | 10/2013 | O'Masta | B32B 3/18 89/36.02 |

OTHER PUBLICATIONS

Department of Defense Manufacturing Process Standard, Materials Deposition, Cold Spray (MIL-STD-3021, Aug. 4, 2008).

* cited by examiner

*Primary Examiner* — Ramsey Zacharia
(74) *Attorney, Agent, or Firm* — Dawn C. Russell; Howard Kaiser

(57) ABSTRACT

Composite materials incorporating high-hardness particulates are provided. Methods for forming composite materials incorporating meta-stable, high-hardness particulates using cold-spray techniques are also provided. The composite materials and methods of the invention beneficially permit the formation of intermixed and graded armors. The composite materials and methods also permit the production of armor compositions with tailored properties.

22 Claims, 5 Drawing Sheets

COMPOSITE MATERIALS, ARMOR FORMED THEREFROM, AND METHODS FOR MAKING SAME

TECHNICAL FIELD

The invention provides composite materials incorporating high-hardness particulates. The invention also provides methods for forming composite materials incorporating meta-stable, high-hardness particulates using cold-spray techniques. The composite materials and methods of the invention permit the formation of intermixed and graded armors. The composite materials and methods also permit the production of armor compositions with tailored properties.

BACKGROUND OF THE INVENTION

Ceramics have found particular application for defeating small arms and high velocity rounds, e.g., armor piercing bullets. They are used in body armor to protect the thorax and for protection of critical areas on vehicles and buildings. The ceramics are fired at high temperatures, and form oxides, nitrides, carbides, and borides that exhibit high hardness and compressive strength. These high-hardness ceramics can be combined with other elements, such as backing layers and/or ballistic-rated body armor fabric, to form protective equipment.

Certain very hard materials, produced under high pressure or temperature environments, are only metastable and cannot be further processed using high temperatures such as those required when sintering ceramics. For example, stishovite is a tetragonal polymorph of quartz ($SiO_2$) that adopts an octahedral coordination chemistry. Stishovite has the highest hardness of any known oxide (9.5 on the Mohs scale), but is unstable and transforms to an amorphous phase when exposed to moderate levels of heat and pressure (about 550° C. at 1 bar). Diamond also has a high hardness (10 on the Mohs scale), but burns to form a gas at temperatures above 850° C. Certain ceramics that can otherwise be processed at high temperatures and pressures cannot be combined during the firing process without undergoing unfavorable chemical reactions.

Stishovite is typically formed under conditions that are associated with very high temperatures and pressures. For example, in nature, it is most frequently found in meteor impact craters. In laboratories, stishovite has been formed by subjecting silica samples to shock waves created by laser beams. Methods for synthesizing stishovite are being developed in order to provide this high-hardness material in a cost-effective manner for use in polishing, grinding, and cutting operations. An example of such a method may be found in U.S. Pat. No. 10,189,715.

U.S. Pat. Nos. 7,955,706 and 7,910,219, issued to Materials and Electrochemical Research (MER) Corporation, is directed to a cermet armor material for highly effective ballistic performance which is comprised of a layer of base metal in which is deposited a layer or layers of ceramic and a compatible metal such that the deposited metal in combination with the base metal forms a continuous matrix around the ceramic particles. The body has a structure which is continuously graded from a highest ceramic content at the outer surface (strike face) decreasing to zero within the base substrate, and containing no abrupt interfaces.

U.S. Pat. Nos. 7,641,709 and 7,279,023, also issued to MER Corporation, are directed to a discontinuous, diamond-particulate-containing, metal-matrix composites of high thermal conductivity, and methods for producing these composites. The manufacturing method includes producing a thin reaction-formed and diffusion-bonded functionally-graded interactive SiC surface layer on diamond particles. The interactive surface converted SiC coated diamond particles are then disposed into a mold and between the particles and permitted to rapidly solidify under pressure. The surface conversion interactive SiC coating on the diamond particles achieves minimal interface thermal resistance with the metal matrix, which translates into good mechanical strength and stiffness of the composites and permits near theoretical thermal conductivity levels to be attained in the composite. Secondary working of the diamond/metal composite can be performed to produce a thin sheet product.

However, existing materials and methods fail to provide intermixed and graded armors containing conventional armor ceramics and high-hardness particulates.

SUMMARY OF THE INVENTION

The invention described herein, including the various aspects and/or embodiments thereof, meets the unmet needs of the art, as well as others, by providing armor materials incorporating high-hardness particulates. The invention also provides methods for forming armor incorporating meta-stable, high-hardness particulates using cold-spray techniques. The armor materials and methods of the invention permit the formation of intermixed and graded armors. The armor materials and methods also permit the production of armor compositions with tailored properties.

According to a first aspect of the invention, a composite material is provided, including a substrate layer selected from the group consisting of metal, ceramic, polymer, and fiber-based materials; and a particulate layer comprising non-deforming particles selected from the group consisting of ceramic particles and high-hardness particles, and combinations thereof, embedded in a matrix formed by cold-sprayed malleable particles selected from the group consisting of metal particles, polymer particles, and combinations thereof.

According to another aspect of the invention, a method for forming a composite material is provided, including providing a substrate layer selected from the group consisting of metal, ceramic, polymer, and fiber-based materials; and cold-spraying a mixture of particles comprising non-deforming particles selected from the group consisting of ceramic particles and high-hardness particles, and combinations thereof, and malleable particles selected from the group consisting of metal particles, polymer particles, and combinations thereof. The cold-sprayed mixture of particles forms a particulate layer comprising high-hardness particles dispersed in a matrix of malleable particles.

Other features and advantages of the present invention will become apparent to those skilled in the art upon examination of the following or upon learning by practice of the invention.

DETAILED DESCRIPTION OF THE INVENTION

Figure 1:
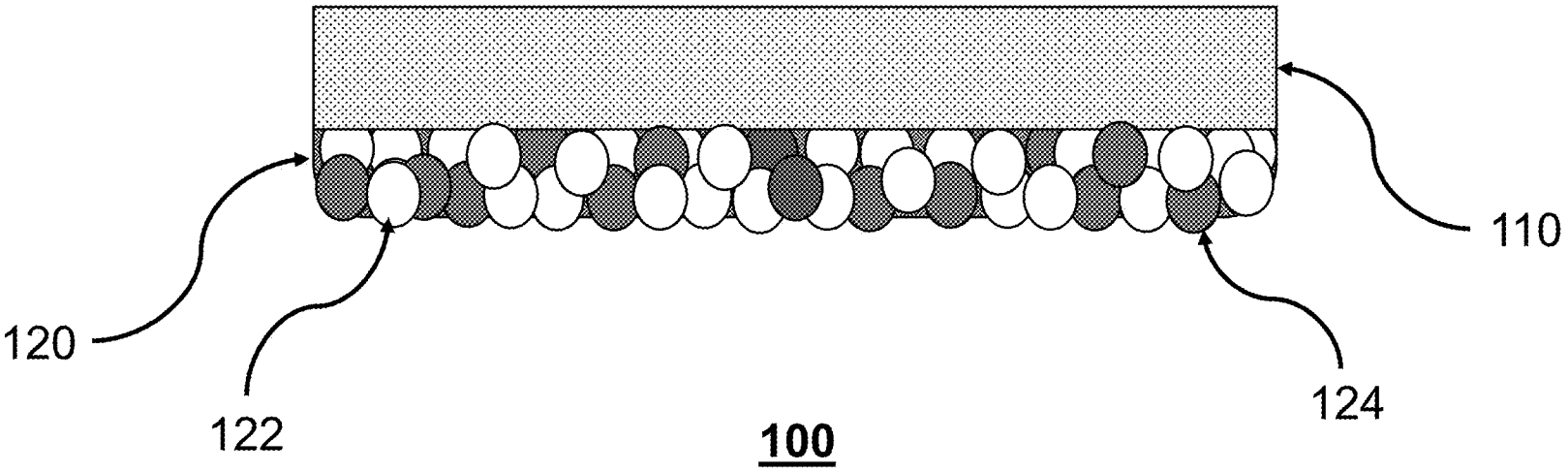
FIG. 1 depicts a composite material formed by cold-spraying particles onto a substrate layer to form a particulate layer.

The invention provides composite materials incorporating high-hardness particulates. The invention also provides methods for forming composite materials incorporating meta-stable, high-hardness particulates using cold-spray techniques. The composite materials and methods of the invention permit the formation of intermixed and graded armors. The composite materials and methods also permit the production of armor compositions with tailored properties (such as hardness, electrical, and heat conduction).

Cold spraying particulate components at low temperatures (i.e., temperatures lower than the melting point of the particulate components being sprayed) expands the range of inclusion of armor combinations and opens up a greater range of possibilities for obtaining new armor materials and designs. The invention beneficially permits the incorporation of meta-stable, high-hardness particulates that could not normally be incorporated into armor systems. These high-hardness particles may include, but are not limited to, stishovite (the hardest known oxide), diamond (which can oxidize at even moderate temperatures), and other meta-stable polymorphs. The invention permits the formation of armor materials containing particles of conventional armor ceramics intermixed with particles of these high hardness materials, which could not be compounded in any other way.

Meta-stable, high-hardness particulates, as well as ceramic oxides, borides, and nitrides, may be comingled with low-melting temperature carrier particles such as aluminum or high-strain rate elastomeric polymers (such as polyurea, polyurethane, silicone elastomers, polytetrafluoroethylene (PDFE), high-density polyethylene (HDPE), low-density polyethylene (LDPE), polypropylene (PP), ultra high molecular weight polyethylene (UHMWPE), poly(methyl)methacrylate (PMMA), polycarbonate (PC), polyvinylchloride (PVC), epoxy, and nylon) during the cold spray process. The carrier particles may form a matrix that holds the high-hardness particles together. Mild temperatures, if desired, can be used to further consolidate the composition to create cermets (i.e., composite materials formed of ceramic and metal) or polymer-particle mixtures. The cold-sprayed coating of particles beneficially provides a high level of penetrator erosion capacity, increasing the effectiveness of traditional armor substrate materials.

High temperatures (i.e., temperatures higher than the melting point of the particulate components being sprayed) can also be used to design functionally-graded cermets using conventional armor ceramics and a high temperature melting metal carrier. This may be utilized, for example, by conducting a cold spraying process in which ceramic particulates are sprayed along with metal particulates, and then firing the cold-sprayed layer to form a cermet. Another ceramic particulate layer could be cold-sprayed on top of this base cermet layer, which may incorporate metastable hard components such as stishovite.

The invention also beneficially provides for the production of armor compositions with tailored electrical and heat-conduction properties. Aluminum, for instance, is highly conductive electrically, and diamond has extremely high heat conductivity. Armor designs with an expanded selection of materials can be formulated using hard meta-stable components deposited by the cold spray process. Specialized cermets that are functionally graded can be additively manufactured in layered or mixed layered formats. Sublayers within the particulate layer of the composite material can be made to support different levels of heat and electrical transmission characteristics, and may incorporate particulate components that support, for example, infrared signature concealment.

Composite Materials

As shown in FIG. 1, the composite materials 100 of the invention include a substrate layer 110 and a particulate material layer 120.

The composite materials of the invention include at least one substrate layer 110. The substrate may be formed using any armor substrate material, including metal, ceramic, polymer, and fiber-based materials, which may be provided in any configuration suitable for the part of the individual or object to be protected. For example, plates may be used that have a shape that is designed to be inserted into ballistic vests, panels may be formed that are configured to be attached to buildings, automobiles, barriers, or other structures being protected. The substrate may be formed of a single armor material, or a combination of materials provided in layers.

Metal substrate layers may be formed using metals selected from the group consisting of aluminum, iron, magnesium, titanium, beryllium, and their alloys (with steel being a preferred alloy of iron). In some aspects of the invention, aluminum 6061 alloy is a preferred substrate material.

Ceramic substrate layers may be formed using armor materials selected from the group consisting of boron carbide, silicon carbide, titanium diboride, and aluminum oxide. Fibers such as aramid and para-aramid may be used to form fiber-based substrate materials. Ultra-high molecular weight polyethylene (UHMWPE) is an exemplary polymer substrate material.

The particulate material layer 120 may be formed from a single layer of particles, or multiple layers of particles, and preferably includes at least two types of particles 122, 124, which may be selected from the group consisting of metal particles, ceramic particles, meta-stable/high-hardness particles, and polymer particles. For example, when formed from ceramic and metal particles, the particulate material layer is designed to provide the temperature resistance and hardness of ceramics, combined with deformability of metals. In some aspects of the invention, a particulate material layer comprising metal and ceramic particles may be consolidated (for example, by application of heat), forming a cermet. In additional aspects of the invention, three or more types of particles may be used to form particulate material layer 120.

In some aspects of the invention, the particulate material layer of the invention includes at least one layer of cold-sprayed particulate material. The layer of cold-sprayed consolidated particulate material 120 may be formed by cold spraying a mixture of particles. Non-deforming particles, such as meta-stable, high-hardness particulates, and ceramic oxides, borides, and nitrides (including aluminum oxide, boron carbide, boron nitride, silicon dioxide, silicon carbide, and titanium diboride), may be comingled with low-melting temperature malleable particles such as metal (aluminum and its alloys, steel alloys) or high-strain rate elastomeric polymers (such as polyurea, polyurethane, silicone elastomers, polytetrafluoroethylene (PDFE), high-density polyethylene (HDPE), low-density polyethylene (LDPE), polypropylene (PP), ultra high molecular weight polyethylene (UHMWPE), poly(methyl)methacrylate (PMMA), polycarbonate (PC), polyvinylchloride (PVC), epoxy, and nylon) during the cold spray process. Malleable particles of metal or polymer may deform as a result of the cold-spraying process to create a matrix that holds the ceramic or high-hardness particles together when subjected to a cold-spray process. In some aspects of the invention, the matrix of malleable particles with ceramic or high-hardness particles may be subjected to heat and/or pressure to form a consolidated particulate material layer. The mixture of particles may include at least 30% malleable particles, preferably at least 40%, more preferably at least 50%, in order to provide proper adhesion of the ceramic or high-hardness particles to the substrate layer.

Highly versatile armor can be produced in accordance with the invention by comingling metal and/or polymer carrier particles with ceramic particles, diamond particles, and/or stishovite particles to form a particulate layer 120 on a substrate 110, for example, by using the cold-spray technique. Additional functionality of the particulate material layer 120 may be obtained by varying the compositions or ratios of particles found in different layers throughout the particulate material layer to achieve a graded composition. For example, in some aspects of the invention, meta-stable, high-hardness particulates are more highly concentrated at the outermost surface of the particulate material layer 120, and metal or polymer particles are more highly concentrated in the portion of the particulate material layer 120 that is in contact with the substrate layer 110. Regardless of the specific particulate material layer 120 composition, the particles 122, 124 may vary in size, from about 1 micrometer to about 100 micrometers, preferably from about 5 micrometers to about 50 micrometers.

Armor

Figure 2:
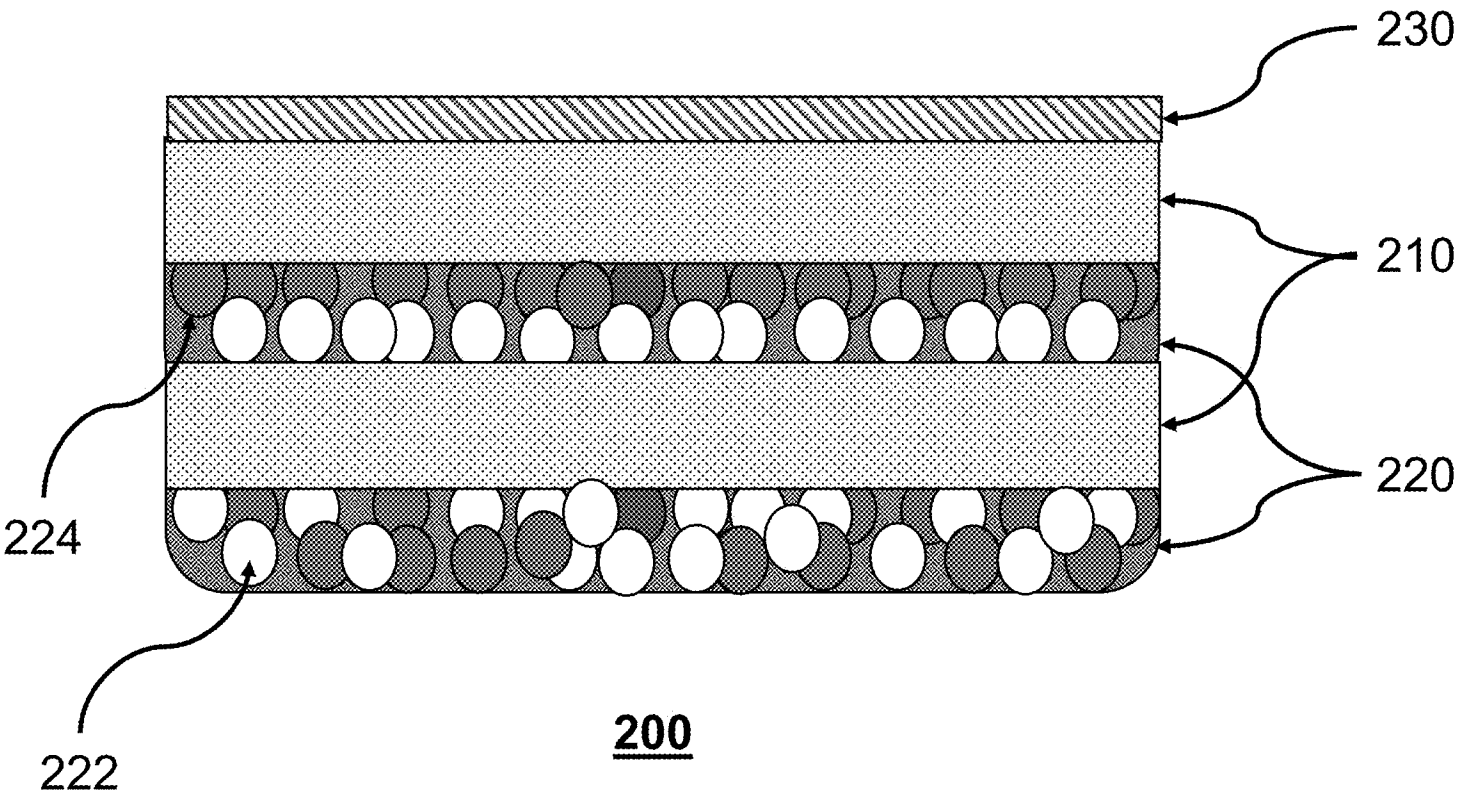
FIG. 2 depicts an armor material formed by providing multiple layers of the composite materials of the invention, as well as a spall liner.

An exemplary armor material 200 in accordance with the invention is shown in FIG. 2.

According to some aspects, a particulate material layer 220 is provided as the outer surface (i.e., the surface that receives an initial impact) of an armor material 200, with the substrate layer 210 provided adjacent to the particulate material layer 220 to support it. A backing material or spall liner 230 may optionally be provided on the inner surface of the armor material (i.e., on the surface of the substrate layer that is not coated with particulate material layer), which faces toward the personnel or equipment protected by the armor, preventing spalling of the composite material in the event of a ballistic impact. Examples of suitable spall liners 230 for use in the invention include one or more layers of ultra-high-molecular-weight polyethylene (UHMWPE), gel-spun fiber material, and aramid or para-aramid fiber materials. Any material capable of arresting residual particles of the composite material from the back side of the target may be used as a backing material.

FIG. 2 shows two layers of the composite material of the invention layered together (each layer including a substrate layer 210, and a consolidated particulate layer 220 formed from ceramic or high-hardness particles 222 and metal or polymer particles 224). The number of layers of composite material is not particularly limited, though weight and overall thickness of the armor may limit the number of layers that are used. In some embodiments of the invention, from 2 to 10 layers of composite material may be provided, preferably 3 to 6 layers. The number of layers may be higher when the consolidated particulate layer 220 is applied to a substrate 210 (such as aluminum, fiber, and polymer substrates) that have a relatively lower density and overall weight as compared to conventional armor materials (such as steel plates and ceramic plates).

The armor materials of the invention may be configured to have any desired shape, depending on the particular armor application (i.e., whether applied to a particular body part as personnel protective equipment, a surface of a vehicle, or a piece of equipment). The armor may be provided as a solid, continuous plate of the composite material, or may be in the form of multiple smaller segments of the composite material that are assembled together, depending on the particular armor application. When smaller pieces of the composite material are used together, it is preferable that the edges of the composite material overlap or are adjacent to one another so that gaps in protection are avoided.

The armor materials of the invention may be provided as substantially flat panels, or as panels that have a curvature designed to conform to a body, vehicle, or equipment surface. For example, the panels may have a convex or concave curvature, depending on the shape and configuration of the area being protected. The armor materials of the invention can also be formed into a variety of shapes incorporating angles or other complex features. If a particular desired shape cannot be imparted to the armor material without compromising its ability to protect against impacts, then multiple segments of the armor material may be configured together to form the desired shape.

The armor materials of the invention may be used in accordance with existing techniques for assembling body armor or vehicle armor, including gluing, mechanically fastening, compressing, and wrapping the armor materials to provide protection from impacts.

When used as personnel protective equipment, the armor materials are preferably configured to be compatible in size and weight with existing systems for accepting armor inserts, such as vests having pockets for holding plate armor in positions that protect vital organs, the spine, and other key anatomical landmarks on a human or service animal being protected. When used as vehicle armor or to protect other equipment, the armor materials may be provided in custom shapes and sizes consistent with the areas to be protected.

Methods

Figure 3:
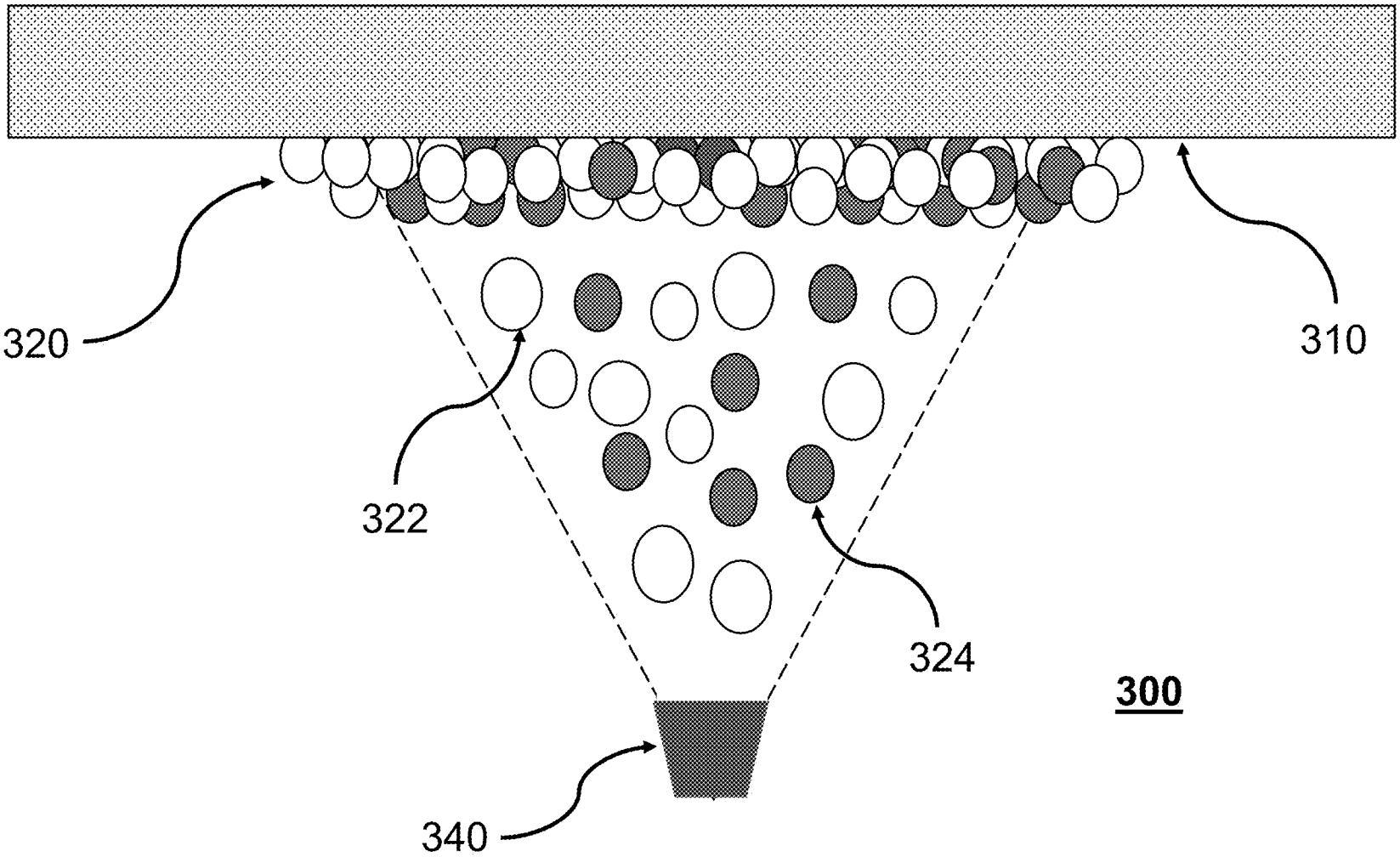
FIG. 3 depicts a cold-spray technique in which meta-stable/ceramic particles and metal/polymer particles are combined while being sprayed onto a substrate.
Figure 4:
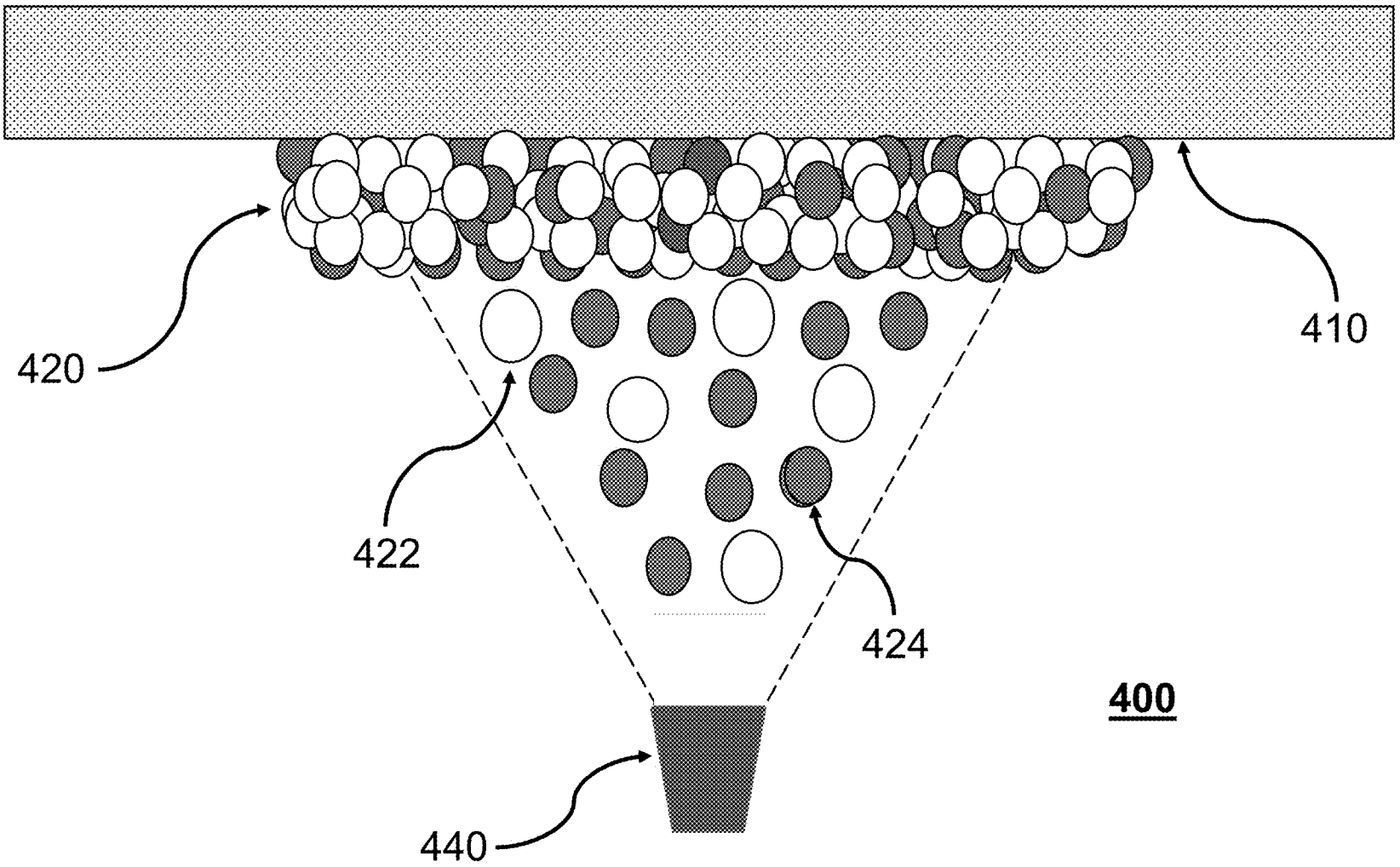
FIG. 4 depicts a cold-spray technique in which different meta-stable/ceramic particles and metal/polymer particles are sprayed onto a substrate to form multiple layers having functionally-graded compositions.
Figure 5:
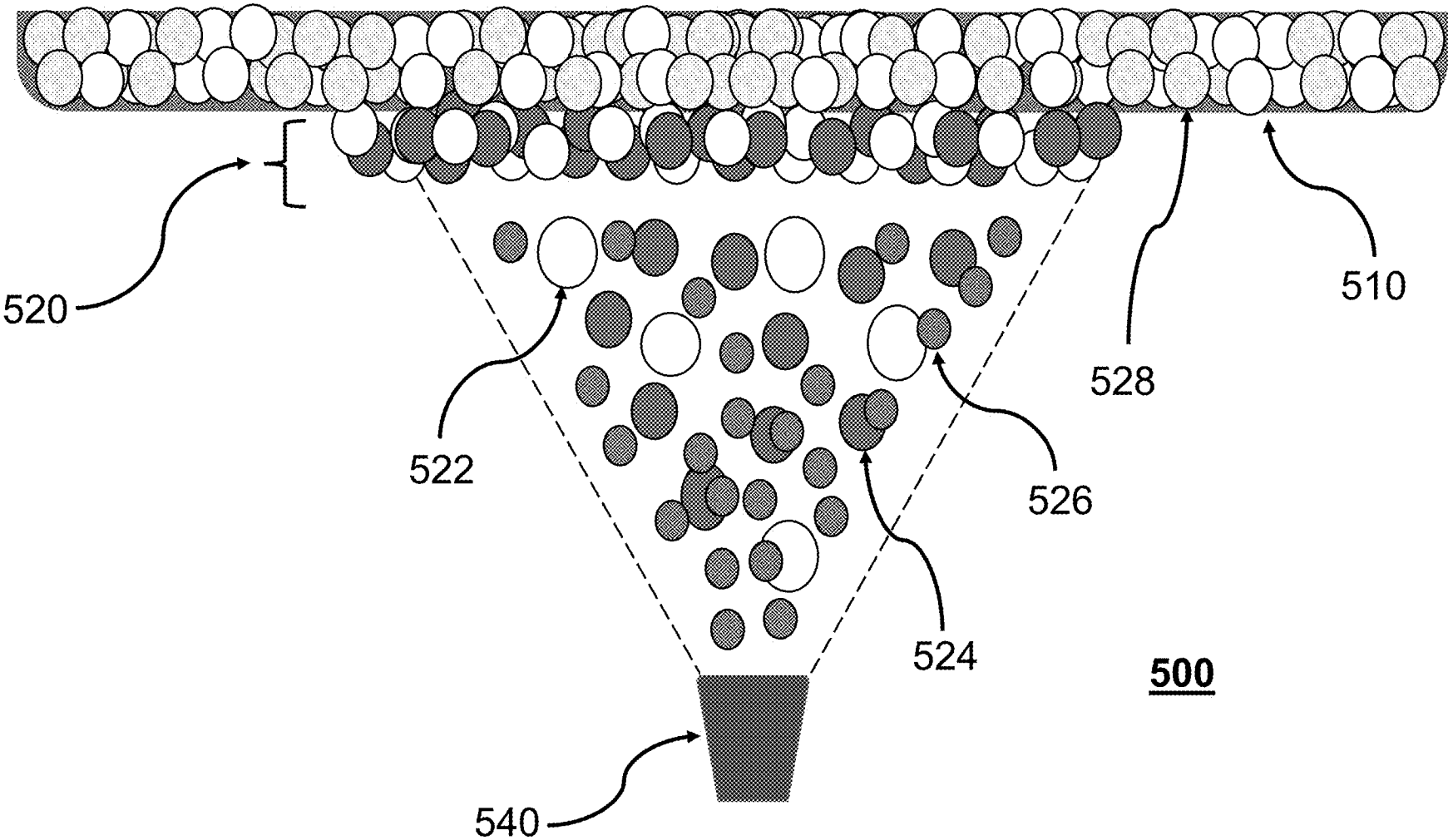
FIG. 5 depicts a cold-spray technique in which meta-stable/ceramic particles and metal/polymer particles are sprayed onto a consolidated cermet substrate formed by cold-spraying conventional ceramic components. The cermet substrate was post-treated at high temperature prior to the cold-spraying with meta-stable/ceramic particles and metal/polymer particles powders.

As shown in FIGS. 3-5, a cold spray process may be used to discharge comingled powders at a high velocity (e.g., up to about 3000 ft/sec) to produce cohesive layers that can be built up on top of each other. Multiple passes can be used, and variations in the composition of the particles being sprayed can be combined to produce, for example, functionally-graded cermets.

As shown in FIG. 3, a composite material 300 is formed by using a nozzle 340 to spray a mixture of ceramic or high-hardness particles 322 and metal or polymer particles 324 at sufficient velocity to form a particulate layer 320 on a metal or ceramic substrate 310.

In FIG. 4, a composite material 400 is formed by using a nozzle 440 to spray a mixture of ceramic or high-hardness particles 422 and metal or polymer particles 424 at sufficient velocity to form a particulate layer 420 on a metal or ceramic substrate 410. The thickness of layer 420 is increased as compared to the layer 320 (shown in FIG. 3) by spraying the mixture of particles over the substrate 410 multiple times.

FIG. 5 shows a composite material 500 formed by using a nozzle 540 to spray particles (ceramic 522, metal 524, polymer 526) at sufficient velocity to form a particulate layer 520 on a substrate 510. Substrate 510 is itself formed from a cohesive, consolidated layer of sprayed particles (ceramic 522, polymer 526, 528), where the composition of the particles differs between the layers in order to provide variations in properties. For example, the particles of substrate 510 may be a combination of polymer particles, ceramic particles, and high-hardness particles. The particles of layer 520 may be a combination of polymer particles, metal particles, and ceramic particles.

Cold gas dynamic spray refers to a method of coating a surface by spraying particulate powders using a supersonic carrier gas at a temperature that does not cause a phase change or stress in the material being sprayed or the target substrate. The Department of Defense Manufacturing Process Standard for Materials Deposition, Cold Spray (MIL-STD-3021, Aug. 4, 2008, the contents of which are incorporated by reference in their entirety), may be consulted for guidance regarding exemplary cold spray deposition processes, materials, and equipment that may be used in accordance with the methods of the invention, and/or in order to produce the armor of the invention. Cold spraying of the particles is preferred in some aspects of the invention.

Optimization of cold gas dynamic spraying variables is done within general limits of the materials to be processed. The temperature of the carrier gas must be lower than the melting temperature or the softening temperature of the accelerated powders. The size of the accelerated particles is preferably from 1 to 100 micrometers, more preferably from about 1 to about 50 micrometers. Carrier gas is at a velocity of Mach 2 to 4, and 1 to 3 MPa pressure. The carrier gas is typically air, nitrogen, helium or a gas mixture with constituents selected from air, nitrogen, and helium. The speed of the particles in the carrier gas is about 300 to 1,200 meters/second, depending on material and the size of particles. Carrier gas temperature, carrier gas velocity and powder particle size are variables that are optimized within known limits.

The substrates used to receive the sprayed powder can include existing armor materials, such as P-900 (a steel plate armor), to further increase their surface hardness. The substrate may also be a prior consolidated particulate composition from spray-up that was optionally post-treated and possibly further compacted at high temperature (see FIG. 5). A highly-rate sensitive polymer base can also be used as a substrate or as an additional spall layer in order to catch any spall fragments generated when the composite material is subjected to an impact, such as a ballistic impact.

During the cold spraying process, the particles deform on impact to adhere or mechanically bond to the surface of the substrate and to each other. Adhesion of less malleable particles that are hard and resistant to deformation (such as high-hardness or ceramic particles) is enhanced by the inclusion of relatively malleable particles (such as polymer or metal particles) in a particle mixture. For this reason, the stishovite or ceramic particles (322, 422, 522) are mixed with a malleable metal or polymer particles (324, 424, 524) to form a particle mixture. Aluminum particles are often used as the malleable metal particles, though in some aspects of the invention polymeric particles are preferably included in the powder being sprayed. Selection of particle components is made to achieve a matrix of particles, adhesion of the particles onto the surface of the substrate, and for compatibility with the composition of the underlying armor substrate.

Further consolidation of the particulate layers of the invention may be achieved by use of heat, resulting in a consolidated particulate layer. Where the cold-sprayed particles include ceramic and metal, a cermet layer may be formed.

The consolidated particulate layers 320, 420, 520 applied by the methods of the invention may have a thickness of from about 0.5 mm to about 18 mm, preferably from about 2 mm to about 12 mm, more preferably from about 4 mm to about 6 mm. The consolidated particulate layer beneficially provides added penetrator erosion capacity when used on a traditional armor substrate.

EXAMPLES

The invention will now be particularly described by way of example. However, it will be apparent to one skilled in the art that the specific details are not required in order to practice the invention. The following descriptions of specific embodiments of the present invention are presented for purposes of illustration and description. They are not intended to be exhaustive of or to limit the invention to the precise forms disclosed. Many modifications and variations are possible in view of the above teachings. The embodiments are shown and described in order to best explain the principles of the invention and its practical applications, to thereby enable others skilled in the art to best utilize the invention and various embodiments with various modifications as are suited to the particular use contemplated.

Examples 1-4

Four sample armor compositions were prepared by coating a substrate with a composite powder. Each of the four composite powders used were produced by ball-milling together the specific constituents of the powder to be cold-sprayed. After ball-milling, each batch of powder was subsequently sieved to pass at least a #230 (63 μm) particle size, followed by a period of oven drying to promote a free flow. This treatment sequence provided a degree of mixing needed for coating uniformity, and also some smearing of the softer aluminum on the hard particulates for even more intimate mixing. The sieving was conducted in order to separate out the small fraction of larger particles remaining, which would present a risk of clogging the cold spray machine feed orifice.

Example 1

Aluminum plate cold-sprayed with a composite powder including about 50 wt % aluminum powder and about 50 wt % $SiO_2$, where the composite powder also contained a small amount of Stishovite.

6061 Al plate was used as a substrate. The substrate was cold-sprayed with a composite coating composition including about 50 wt % aluminum powder and about 50 wt % $SiO_2$, where the composite powder also contained a small amount of Stishovite. The composite powder was ball-milled, sieved to pass through a #230 (63 micron) mesh, and oven-dried to promote free flow of the particles. This processing provides thorough mixing of different particle types, eliminates larger particles that could clog the cold spray machine feed orifice, and causes some smearing of the softer aluminum onto the harder particulates.

The powder was sprayed onto the 6061 Al plate substrate using a cold-spraying apparatus, operating at an He gas temperature of 100° F. This coating was applied to a thickness of about ¼ inch.

Example 2

Stainless steel 304 foam impregnated with P1000 urethane, cold-sprayed with a composite powder including 50 wt % aluminum powder and 50 wt % $SiO_2$ containing some Stishovite.

A composite plate formed by impregnating a stainless 304 foam with P1000 urethane was used as a substrate. The substrate was sprayed with the same powder as described in Example 1, but at an He gas temperature of 325° F. The higher temperature was used to promote bonding of the powder to the polymer surface by softening it during the spraying process. This coating was applied to a thickness of about ¼ inch.

Example 3

Aluminum plate cold-sprayed with a composite powder including 88 wt % aluminum powder/12 wt % polyacrylic acid polymer powder.

6061 Al plate was used as a substrate. The coating composition included 88 wt % pure Al powder/12 wt % polyacrylic acid powder (<45 μm). The coating composition was ball-milled, sieved, and oven-dried, and sprayed onto the 6061 Al plate using a cold-spraying apparatus operating using He gas at ambient temperature (i.e., room temperature). The lower temperature was used to forestall any polymer melting and clogging of the spray orifice. The fraction of polymer in this composite coating is preferably limited so as to preserve the metallic bond character of the overall coating. This coating was applied to a thickness of about ¼ inch.

Example 4

Aluminum plate cold-sprayed with a composite powder including 40 wt % aluminum powder, 40 wt % $SiO_2$ containing some Stishovite, and 20 wt % boron carbide ($B_4C$).

6061 Al plate was used as a substrate. The coating composition included the powder of Example 1, to which was added 20 wt % boron carbide ($B_4C$) 10 μm powder, followed by additional ball-milling. The resulting constituent fractions were about 40% aluminum powder, about 40% $SiO_2$ powder containing some Stishovite, and about 20% of boron carbide. Again, the metal (aluminum) portion is preferably provided at least at the 40% level in order to provide enough soft particles in the composite powder for the coating to bond to the substrate. This coating was sprayed onto the 6061 Al plate using a cold-spraying apparatus operating at an He gas temperature of 100° F., and applied to a thickness of about ¼ inch.

It will, of course, be appreciated that the above description has been given by way of example only and that modifications in detail may be made within the scope of the present invention.

Throughout this application, various patents and publications have been cited. The disclosures of these patents and publications in their entireties are hereby incorporated by reference into this application, in order to more fully describe the state of the art to which this invention pertains.

The invention is capable of modification, alteration, and equivalents in form and function, as will occur to those ordinarily skilled in the pertinent arts having the benefit of this disclosure. While the present invention has been described with respect to what are presently considered the preferred embodiments, the invention is not so limited. To the contrary, the invention is intended to cover various modifications and equivalent arrangements included within the spirit and scope of the description provided above.

What is claimed:

1. A composite material comprising at least two substrate layers and at least two particulate layers, wherein:

said at least two substrate layers and said at least two particulate layers are alternately arranged whereby no said substrate layer is adjacent another said substrate layer and no said particulate layer is adjacent another said particulate layer;

each said substrate layer is selected from the group of materials consisting of metal, ceramic, polymer, fiber-based materials, and combinations thereof;

each said particulate layer consists of malleable particles and non-deforming particles;

said malleable particles are selected from the group of particles consisting of metal particles, polymer particles, and combinations thereof;

said non-deforming particles are selected from the group of particles consisting of ceramic particles, high-hardness particles, and combinations thereof;

said high-hardness particles are selected from the group of particles consisting of stishovite particles, diamond particles, and combinations thereof;

said non-deforming particles are embedded in a matrix consisting of said malleable particles;

the size of every said malleable particle and every said non-deforming particle is between about 2 micrometers and about 100 micrometers.

2. The composite material of claim 1, wherein each said substrate layer is metal, and is selected from the group of materials consisting of steel, aluminum, aluminum alloys, titanium, titanium alloys, and combinations thereof.

3. The composite material of claim 1, wherein each said substrate layer is ceramic, and is selected from the group of materials consisting of boron carbide, silicon carbide, titanium diboride, aluminum oxide, and combinations thereof.

4. The composite material of claim 1, wherein each said substrate layer is a polymer including ultra high molecular weight polyethylene (UHMWPE).

5. The composite material of claim 1, wherein each said substrate layer is a fiber-based material, and is selected from the group of materials consisting of aramid, para-aramid, and combinations thereof.

6. The composite material of claim 1, wherein said ceramic particles are selected from the group of particles consisting of aluminum oxide, boron carbide, boron nitride, silicon carbide, silicon dioxide, and titanium diboride.

7. The composite material of claim 1, wherein said metal particles are selected from the group of particles consisting of steel, aluminum, aluminum alloys, and combinations thereof.

8. The composite material of claim 1, wherein said polymer particles are selected from the group of particles consisting of polyurea, polyurethane, silicone elastomers, polytetrafluoroethylene (PDFE), high-density polyethylene (HDPE), low-density polyethylene (LDPE), polypropylene (PP), ultrahigh molecular weight polyethylene (UHMWPE), poly(methyl)methacrylate (PMMA), polycarbonate (PC), polyvinylchloride (PVC), epoxy, nylon, and combinations thereof.

9. The composite material of claim 1, wherein each said substrate layer includes aluminum 6061 alloy.

10. The composite material of claim 9, wherein each said particulate layer includes stishovite particles.

11. The composite material of claim 9, wherein each said particulate layer includes at least one cermet.

12. The composite material of claim 1, further comprising a spalling layer, wherein each said substrate layer has two opposite substrate surfaces, and wherein a said spalling layer is provided on a said substrate surface that is not contiguous a said particulate layer.

13. A method for forming the composite material of claim 1, comprising:

providing at least two substrate layers selected from the group of materials consisting of metal, ceramic, polymer, fiber-based materials, and combinations thereof; and cold-spraying a mixture of particles comprising non-deforming particles and malleable particles on each substrate layer, said non-deforming particles selected from the group of particles consisting of ceramic particles, high-hardness particles, and combinations thereof, said malleable particles selected from the group of particles consisting of metal particles, polymer particles, and combinations thereof;

wherein said cold-sprayed mixture of particles forms a particulate layer including high-hardness particles dispersed in a matrix of malleable particles, and said at least two substrate layers and particulate layers are alternatively arranged whereby no said substrate layer is adjacent another said substrate layer and no said particulate layer is adjacent another said particulate layer.

14. The method of claim 13, wherein said substrate layer includes aluminum 6061 alloy.

15. The method of claim 14, wherein said high-hardness particles include at least one of diamond particles and stishovite particles.

16. The method of claim 14, wherein said particulate layer includes at least one cermet.

17. The composite material of claim 1, wherein each said particulate layer is formed by cold-spraying of said malleable particles and said non-deforming particles whereby said matrix tends to hold said non-deforming particles together.

18. The composite material of claim 1, wherein:

said ceramic particles are titanium diboride;

said metal particles are steel.

19. The composite material of claim 1, wherein:

each said particulate layer is characterized by two opposite surfaces consisting of an exposed said surface and a non-exposed said surface;

at least one said particulate layer has an exposed said surface that is an armor strike face, and a non-exposed said surface that is contiguous a said substrate layer;

said malleable particles are more concentrated toward the non-exposed said surface that is contiguous a said substrate layer, and are less concentrated toward the exposed said surface that is an armor strike face;

said non-deforming particles are more concentrated toward the exposed said surface that is an armor strike face, and are less concentrated toward the non-exposed said surface that is a contiguous said substrate layer.

20. The composite material of claim 1, wherein the composite material is characterized by at least one of the following:

at least two said substrate layers differ with respect to said selection from said group of said materials of said substrate layer;

at least two said particulate layers differ with respect to said selection from said group of said particles of said particulate layer;

at least two said particulate layers are the same with respect to said selection from said group of said particles of said particulate layer, and differ with respect to at least one ratio of said particles selected from said group of said particles of said particulate layer;

at least two said particulate layers are the same with respect to said selection from said group of said particles of said particulate layer, and differ with respect to distribution in said particulate layer of at least one said particle selected from said group of said particles of said particulate layer.

21. The composite material of claim 1, wherein at least one said particulate layer is characterized by two opposite surfaces consisting of a first said surface and a second said surface, and is further characterized by at least one of the following:

said malleable particles are more concentrated toward the first said surface and are less concentrated toward the second said surface;

said non-deforming particles are more concentrated toward the first said surface and are less concentrated toward the second said surface.

22. The composite material of claim 1, wherein:

a said particulate layer is characterized by two opposite surfaces consisting of an exposed said surface and a non-exposed said surface, the exposed said surface being an armor strike face, the non-exposed said surface being contiguous a said substrate layer;

said malleable particles are more concentrated toward the non-exposed said surface that is contiguous a said substrate layer, and are less concentrated toward the exposed said surface that is an armor strike face;

said non-deforming particles are more concentrated toward the exposed said surface that is an armor strike face, and are less concentrated toward the non-exposed said surface that is contiguous a said substrate layer.

* * * * *